US006684905B2

(12) United States Patent
Yamaguchi

(10) Patent No.: US 6,684,905 B2
(45) Date of Patent: Feb. 3, 2004

(54) CONSTRUCTION MACHINE

(75) Inventor: Kazuyoshi Yamaguchi, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 29 days.

(21) Appl. No.: 10/060,223

(22) Filed: Feb. 1, 2002

(65) Prior Publication Data

US 2002/0124892 A1 Sep. 12, 2002

(30) Foreign Application Priority Data

Mar. 6, 2001 (JP) ..... 2001-062109

(51) Int. Cl.[7] ..... F15B 13/08
(52) U.S. Cl. ..... 137/596.15; 91/529; 137/557
(58) Field of Search ..... 91/529; 137/557, 137/596.15

(56) References Cited

U.S. PATENT DOCUMENTS 4,970,941 A * 11/1990 Reinhardt ..... 137/884
4,986,165 A * 1/1991 Miyaoka ..... 137/596.15

FOREIGN PATENT DOCUMENTS

JP 7-20342 4/1995

* cited by examiner

*Primary Examiner*—Gerald A. Michalsky
(74) *Attorney, Agent, or Firm*—Oblon, Spivak, McClelland, Maier & Neustadt, P.C.

(57) ABSTRACT

The present invention provides a construction machine with a structure of pilot pipe comprising detection ports for detecting pilot pressure in a body of a switching valve, so that the number of pipe connecting positions and pipe assembly parts such as joints and the like can be decreased and arrangement of the pipe can be simplified.

6 Claims, 5 Drawing Sheets

CONSTRUCTION MACHINE

BACKGROUND OF THE INVENTION

1. Field of the Invention

The present invention relates to a construction machine with a piping structure of pilot pipe.

2. Description of the Related Art

Conventionally, one of pilot ports of direction control valves is determined according to operating direction of an operating valve, when pilot pressure derived from the operating valve by means of a control lever is applied to the pilot ports of direction control valves. As a result, working direction of various hydraulic actuators is determined correspondingly to the operating direction of the operating valve. If operating pattern is switched, a switching valve is provided between the operating valve and the direction control valves. By switching the switching valve, the operating pattern can be switched.

In FIG. 5, an example of pilot pipe structure having the switching valve is shown. Pilot pressure derived from left/right operating valve (hereinafter, referred to as remote control valve) 19*a*, 19*b* by means of operation of a control lever not shown is applied to one of the direction control valves 4–9 selected by switching pipe ports of the switching valve 17'. The pilot pipes 20*a*, 20*b* extending from the switching valve 17 to the direction control valves 6–9 are provided with a pressure sensor block 17*c*'. Monitoring of pressure is carried out by means of output signal from the pressure sensors 21*a*, 21*b* provided in the block 17*c*'.

In this case, because the pilot pipes 20*a*, 20*b* connecting the switching valve 17' and the direction control valves 6–9 to each other are provided with the pressure sensor block 17*c*', the number of pipe connecting positions and pipe assembly parts such as joints and the like becomes larger. Accordingly, arrangement of pipe becomes complex. Specifically, when pipes are required to be arranged in a small space such as a small sized hydraulic excavator, arrangement of pipes becomes more complex because of condensation of the pipe assembly parts.

SUMMARY OF THE INVENTION

The object of the present invention is to provide a construction machine with a piping structure of pilot pipe capable of decreasing the number of pipe connecting positions and pipe assembly parts such as joints to simplify arrangement of pipe.

The piping structure of pilot pipe in a construction machine according to the present invention has following construction.

The piping structure of pilot pipe comprises: a switching valve for applying pilot pressure derived from an operating valve to one of a plurality of pilot ports of direction control valves; a pressure sensor for detecting the pilot pressure; and detection ports provided in a body of the switching valve for guiding the pilot pressure to the pressure sensor.

In this case, because the body of the switching valve is provided with the detection ports for guiding the pilot pressure to the pressure sensor, the switching valve has functions of a pressure sensor block in common. As a result, the pressure sensor block need not be provided as in the conventional art. Accordingly, the number of pipe connecting positions and pipe assembly parts is decreased as many as the block. For this reason, improvement of quality and costreduction can be accomplished.

Also, because space for providing the pressure sensor block is not required, the space can be used usefully to simplify arrangement of pipe.

BRIEF DESCRIPTION OF THE DRAWINGS

FIG. 2*a* is a plan view of the switching valve schematically showing a state that pilot pipes and pressure sensors are provided thereto, FIG. 2*b* is a front view of the switching valve when it is turned or a side view thereof and FIG. 2*c* is a cross-sectional view taken along an arrow of FIG. 2*b;*

FIG. 3*a* is a plan view of the switching valve schematically showing a state that pilot pipes and pressure sensors are provided thereto, FIG. 3*b* is a front view of the switching valve when it is turned, and FIG. 3*c* is a cross-sectional view taken along an arrow of FIG. 3*b;*

FIG. 4*a* is a plan view of the switching valve schematically showing a state that pilot pipes and pressure sensors are provided thereto, FIG. 4*b* is a front view of the switching valve when it is turned or a side view thereof, and FIG. 4*c* is a cross-sectional view taken along an arrow of FIG. 4*b*.

DESCRIPTION OF THE PREFERRED EMBODIMENTS

Figure 1:
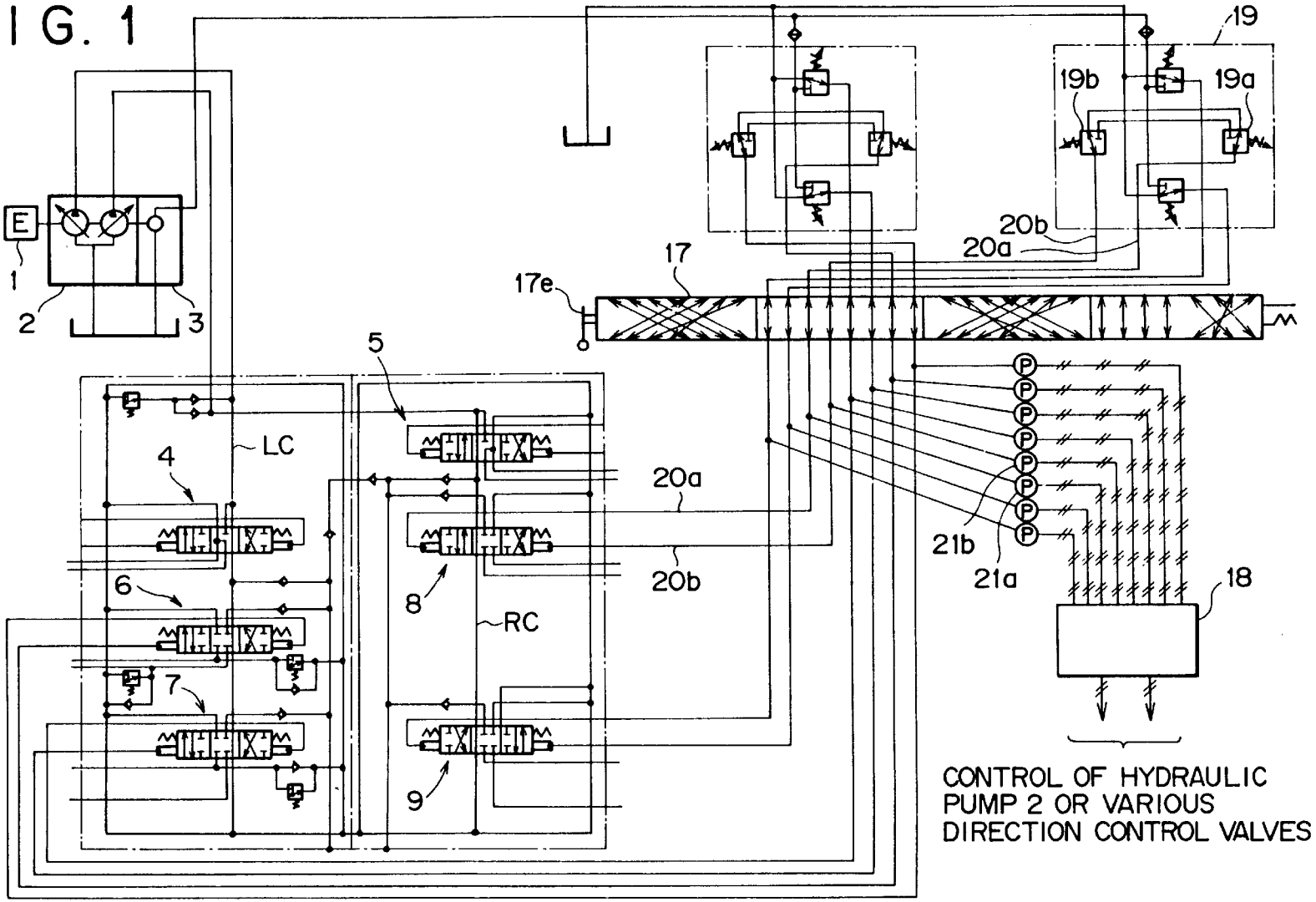
FIG. 1 is a diagram showing a hydraulic circuit of a hydraulic excavator according to an embodiment of the present invention.

Now, the present invention will be explained on the basis of embodiments shown in the drawings. These embodiments are only preferred embodiments of the present invention and the present invention is not limited to them.

FIG. 1 is a diagram showing a hydraulic circuit of hydraulic excavator according to an embodiment of the present invention.

In FIG. 1, a variable capacity type of hydraulic pump 2 and a pilot pump 3 are operated, respectively, by means of driving of an engine 1 mounted on an upper rotating body of the hydraulic excavator as a construction machine. Pressure oil discharged from the hydraulic pump 2 is supplied to a right traveling direction control valve 4, a bucket direction control valve 6 and a boom direction control valve 7, arranged in a center bypass line LC at left of FIG. 1. At the same time, the pressure oil is also supplied to a left traveling direction control valve 5, a rotating direction control valve 8 and an arm direction control valve 9, arranged in a center bypass line RC at right of FIG. 1.

The pressure oil discharged from the pilot pump 3 is used as a pressure source for various controls. Here, the pilot pressure discharged from a left/right operating valve (hereinafter, referred to as a remote control valve) 19*a*, 19*b* by means of operation of an control lever not shown in applied to one selected from the direction control valves 6–9, by manually switching pipe ports of a switching valve 17. Detection ports of the switching valve 17 are directly provided with pressure sensors 21*a*, 21*b*. A controller 18 is constructed to control quantity of flow of the hydraulic pump 2 and various direction control valves, according to output signal from the pressure sensors 21*a*, 21*b*.

Arrangement of the pipes including the pilot pipe is carried out on the basis of the hydraulic circuit. According to the present invention, even if pipes are inevitably arranged in a small space such as a compact hydraulic excavator, the conventional problem that arrangement of the pipes becomes very complex by means of concentration of pipe assembly parts can be solved. In the present invention, the conventional pressure sensor block provided separately from the switching valve can be omitted. Now, structure of the switching valve 17 of the present invention will be explained.

Figure 2A:
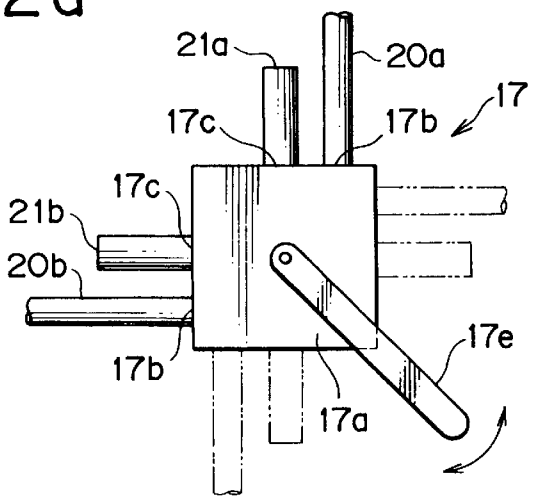
FIGS. 2*a* through 2*c* show structures of a switching valve according to an embodiment of the present invention, where
Figure 2B:
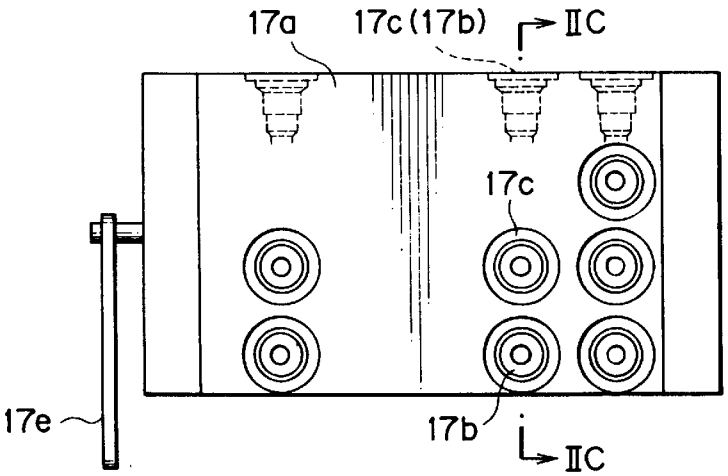
Figure 2C:
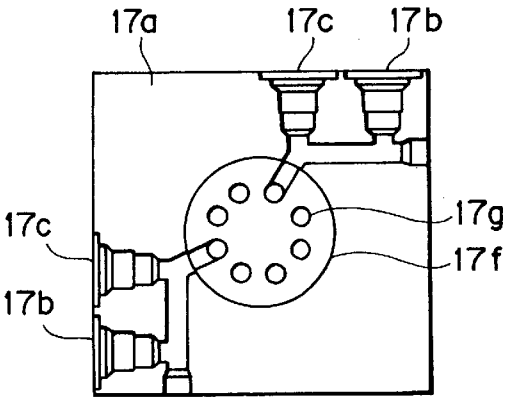
Figure 3A:
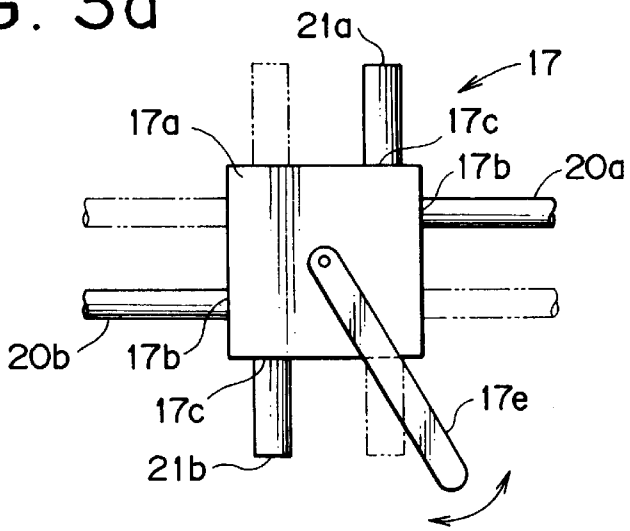
FIGS. 3*a* through 3*c* show structures of a switching valve according to another embodiment of the present invention, where
Figure 3B:
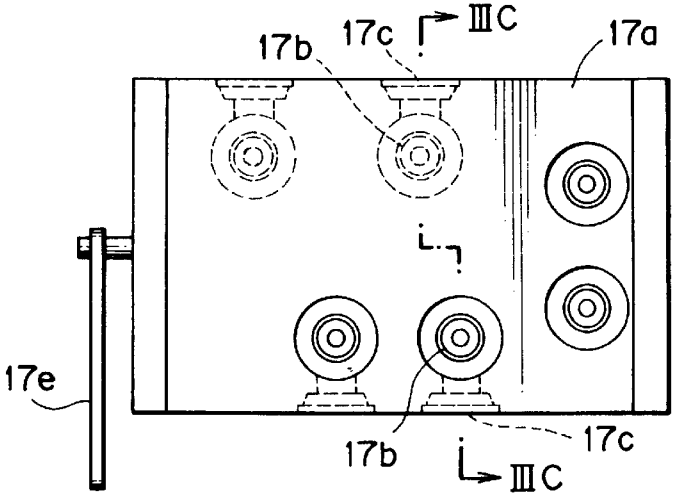
Figure 3C:
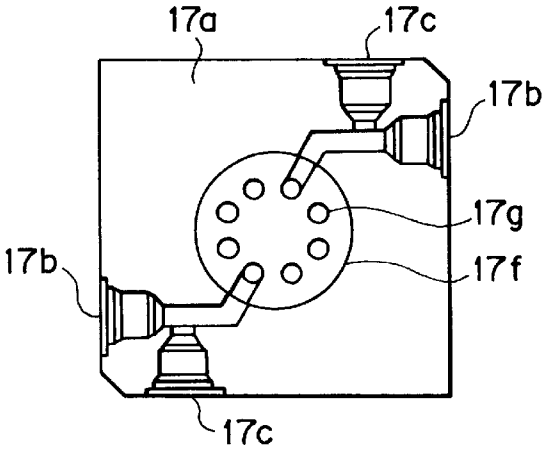
Figure 4A:
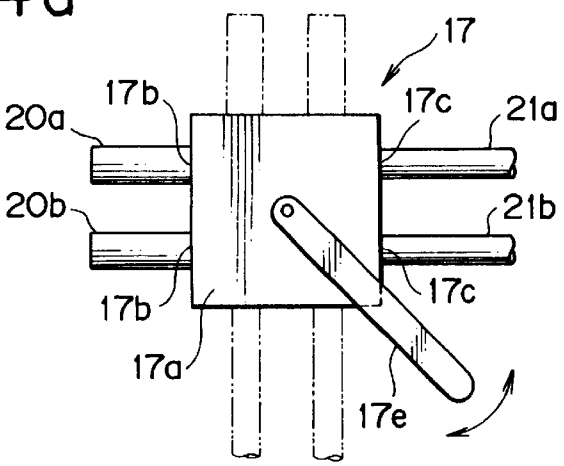
FIGS. 4*a* through 4*c* show detailed structures of a switching valve according to another embodiment of the present invention, where
Figure 4B:
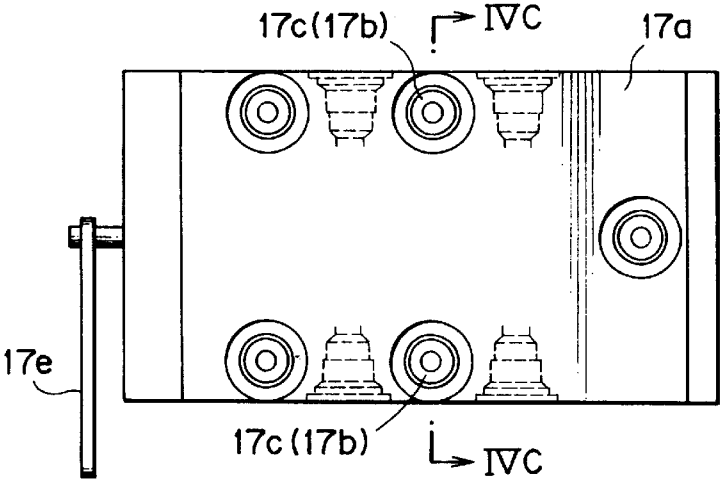
Figure 4C:
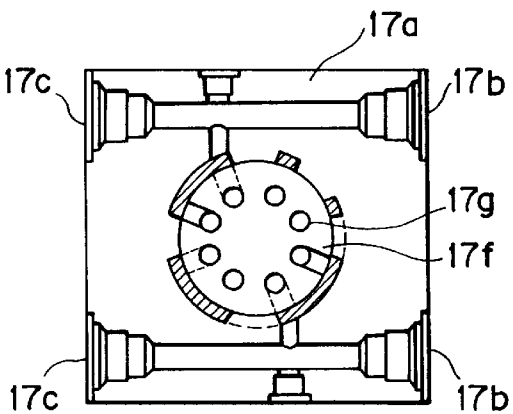
Figure 5:
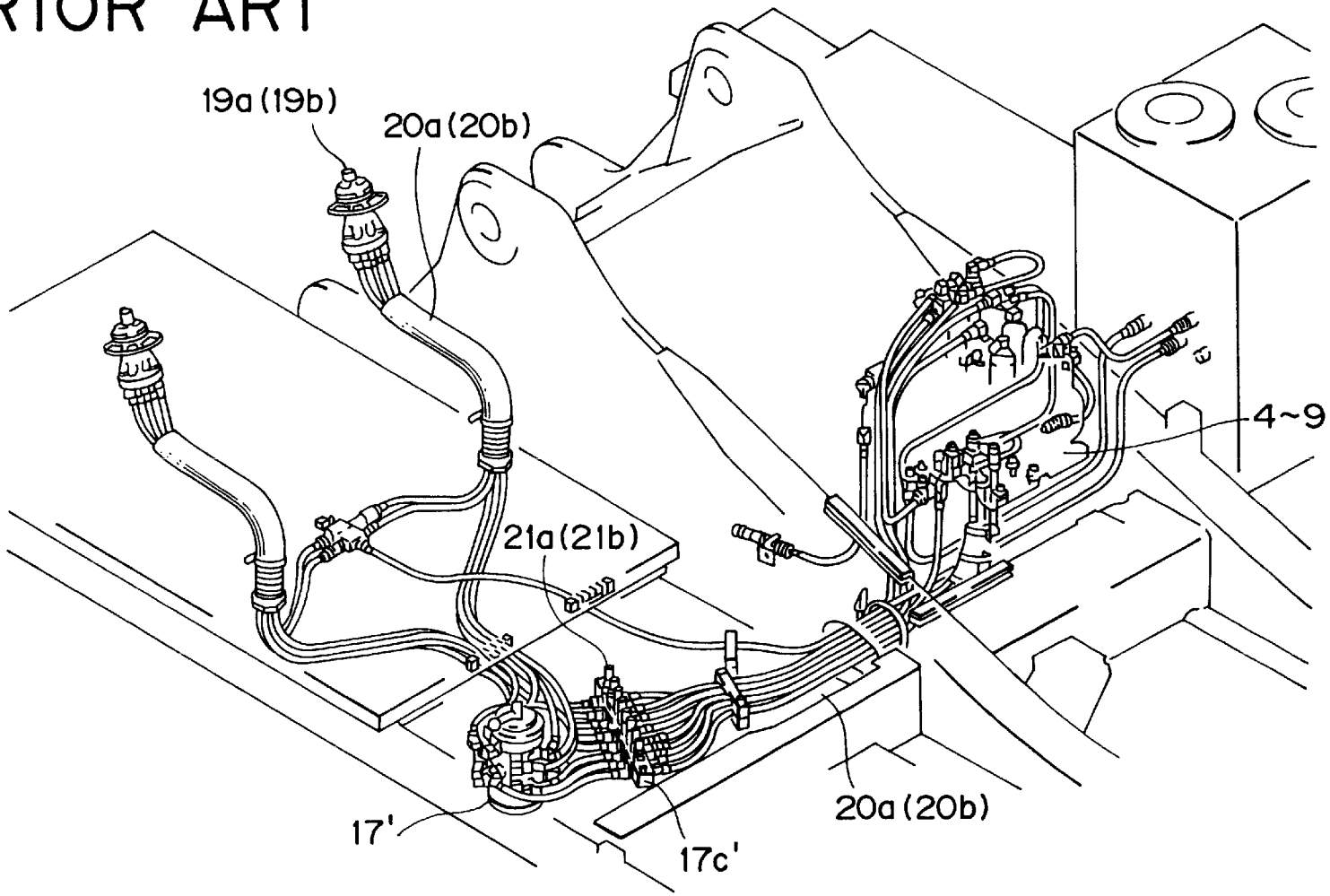
FIG. 5 PRIOR ART
FIG. 5 is a schematic diagram showing an example of pilot pipe structure in the conventional hydraulicexcavator.

FIG. 2*a*–FIG. 4*c* show respective structures of the different switching valves. Specifically, FIGS. 2*a*, 3*a* and 4*a* are plan views of the switching valve schematically showing a state that pilot pipes and pressure sensors are provided thereto. FIGS. 2*b*, 3*b* and 4*b* are front views of the switching valve when it is turned. FIGS. 2*c*, 3*c* and 4*c* are cross-sectional views taken along arrows of FIGS. 2*b*, 3*b* and 4*b*, respectively. Furthermore, the arrangement of pilot pipes and pressure sensors enables a state indicated with solid lines and a state indicated with dotted lines in FIGS. 2*a*, 3*a* and 4*a*. Here, arrangement indicated with solid lines will be explained.

As shown in FIG. 2*a*–FIG. 4*c*, a body 17*a* of the switching valve 17 is formed approximately in a shape of rectangular parallelepiped. At a side surface thereof, plural pipe ports 17*b* are provided. To these pipe ports 17*b*, pilot pipes 20*a*, 20*b* extending through proper joints from the operating valve 19*a*, 19*b* and to the direction control valves 6–9 are connected, respectively. The body 17*a* is provided with detection ports 17*c* for detecting the pilot pressure, correspondingly to the pilot pipes 20*a*, 20*b*. The pressure sensors 21*a*, 21*b* can be directly provided in these detection ports 17*c*. The detection ports 17*c* are formed to diverge from the pipe ports 17*b*, in the body 17*a*. For this reason, by means of the pressure sensors 21*a*, 21*b*, inner pressure of the pilot pipes 20*a*, 20*b* connected to the pipe ports 17*b* corresponding to the detection ports provided with the sensors 21*a*, 21*b* can be directly detected.

Also, a control lever 17*e* is provided at upper portion of the body 17*a* to be projected. A rotor 17*f* is able to rotate within the body 17*a* by means of operation of the control lever 17*e*. Oil grooves 17*g* having predetermined shapes are formed in the rotor 17*f*. In FIG. 2*a*–FIG. 4*c*, the rotor 17*f* rotates within the body 17*a* by means of rotary operation of the control lever 17*e*. As a result, desired pipe ports 17*b* can be communicated with each other via the oil grooves 17*g*. At the same time, the detection ports 17*c* corresponding to the pipe ports 17*b* are communicated, too.

In FIG. 2*a*–FIG. 2*c*, the pipe ports 17*b* and the detection ports 17*c* are provided in the same plane of the body 17*a* of switching valve.

On the contrary, in FIGS. 3*a*–3*c* and FIGS. 4*a*–4*c*, the detection ports 17*c* are provided in another plane rather than the plane, of the body 17*a* of switching valve, in which the pipe ports 17*b* are provided. Accordingly, positions of the pilot pipes 20*a*, 20*b* connected to the pipe ports 17*b* are not confused with positions of the pressure sensors 21*a*, 21*b* connected to the detection ports 17*c*, suitably.

That is, in FIG. 3*c*, the pipe ports 17*b* are provided in left and right planes of the body 17*a* of switching valve and the detection ports 17*c* are provided in upper and lower planes thereof. In this case, the pipe ports 17*b* and the detection ports 17*c* are arranged in planes adjoining each other, of the switching valve 17, respectively. For this reason, possibility that the pilot pipes 20*a*, 20*b* and the pressure sensors 21*a*, 21*b* connected to the respective ports interfere each other becomes smaller. Therefore, arrangement of pipes can be simplified and characteristics of assembly and maintenance can be much improved.

Also, in FIG. 4*c*, the pipe ports 17*b* are provided in a left plane of the body 17*a* of switching valve and the detection ports 17*c* are provided in a right plane thereof. As in this example, one plane provided with the pipe ports and another plane provided with the detection ports face each other.

In this case, the pilot pipes 20*a*, 20*b* and the pressure sensors 21*a*, 21*b* can be put together in a limited space, respectively. That is, positions in which the pilot pipes are connected to the pipe ports and positions in which the pressure sensors are provided with the detection parts are integrated or put together. As a result, possibility that the pilot pipes and the pressure sensors interfere each other is furthermore decreased. Also, arrangement of pipes is simplified, so that characteristics of assembly and maintenance thereof can be much improved.

As explained above, according to the present embodiment, the detection ports 17*c* for guiding the pilot pressure to the pressure sensors 21*a*, 21*b* are provided in the body 17*a* of switching valve 17. Also, the switching valve itself further has a function as the pressure sensor block. For this reason, the pressure sensor block as in the conventional art is not necessary to be separately provided. Accordingly, the number of pipe connecting positions and various pipe assembly parts can be decreased. As a result, improvement of quality and cost reduction can be accomplished. Also, by means of useful use of a space from which the pressure sensor block is omitted, arrangement of pipes can be simplified. For this reason, the present invention is suitable for a small-sized hydraulic excavator in which pipes have to be inevitably arranged in a small or limited space.

Moreover, in the above embodiment, the switching valve 17 is manually operated by means of the control lever 17*e*. By making the control lever 17*e* extend through links, remote operation thereof may be carried out mechanically, or by operating a button provided at upper portion of the control lever 17*e* with one touch, remote operation may be carried out. In this case, operation of the control lever 17*e* does not have to be considered in arranging the switching valve 17. Therefore, arrangement of pipes can be more simplified.

Also, in the above embodiment, the body 17*a* of switching valve 17 is formed approximately in a rectangular parallelepiped shape. Of cause, it may be formed in a polyhedron shape having more planes. Also, only port portions may be projected from the body having a cylinder shape in directions as in FIGS. 3*a*–3*c* and FIGS. 4*a*–4*c*. In this case, the switching valve 17 can be made more light-weight and compact.

Also, in the above embodiment, only pipe ports are provided in the switching valve 17. In addition, the switching valve 17 may have a throttle or a check valve built-in. In this case, arrangement of pipes can be much more simplified.

Also, in the above embodiment, the switching valve 17 is directly equipped with the pressure sensors 21*a*, 21*b*. Detection pipes may be connected through proper joints to the detection ports 17*c*. In this case, the detection pipes are required, but dispersion of pipes is possible unlike providing the conventional pressure sensor block thereby to simplify arrangement of pipes.

Particularly, when the pressure sensor is not required to some pilot pipes, size of the block is not varied because a stopper is provided to the pressure sensor block in the conventional art. Therefore, the arrangement of pipes is not simplified yet. On the contrary, according to the present invention, a space corresponding to the pressure sensor is saved in the dispersed pipes described above because of no pressure sensor.

Therefore, the present invention is suitable for a small-sized hydraulic excavator in which pipes have to be arranged inevitably in a smaller limited space.

Also, in the above embodiment, pressure control is carried out on the basis of signals from the pressure sensors 21*a*, 21*b* by the controller 18. For example, only the pressure sensors 21*a*, 21*b* are provided to automatically monitor the detected pressure, or a pressure meter may be provided instead of the pressure sensors for an operator to monitor the pressure with his eyes. Like this, circuit construction can be much more simplified.

In the present embodiment, the present invention was applied to a hydraulic excavator, but coverage of the present invention is not limited to this and for example, the present invention may be applied to pilot pipe structure of other construction machine such as a crane and the like.

As described above, although preferred embodiments of the present invention were disclosed, the scope of protection of the present invention should not be limited to them.

I claim:

1. A construction machine with a piping structure of pilot pipe, comprising:

a switching valve for applying pilot pressure derived from an operating valve to one of a plurality of pilot ports of direction control valves;

a pressure sensor for detecting said pilot pressure; and detection ports provided in a body of said switching valve, said detection ports guiding said pilot pressure to said pressure sensor.

2. The construction machine according to claim 1, further comprising pipe ports provided in the body of said switching valve said pipe ports being connected to said operating valve or said direction control valves.

3. The construction machine according to claim 2, wherein the body of said switching valve is a polyhedron.

4. The construction machine according to claim 3, wherein one plane of said polyhedron is provided with said pipe ports and another plane of said polyhedron is provided with said detection ports.

5. The construction machine according to claim 4, wherein said one plane and said another plane adjoin each other.

6. The construction machine according to claim 4, wherein said one plane and said another plane face each other.

* * * * *